United States Patent [19]

Matsushita et al.

[11] Patent Number: 5,075,170

[45] Date of Patent: Dec. 24, 1991

[54] THERMAL TRANSFER RECORDING SHEET

[75] Inventors: Toshihiko Matsushita; Kiyoshi Shibuya, both of Tokyo; Sadao Morishita, Ushiku, all of Japan

[73] Assignee: Mitsubishi Paper Mills Limited, Tokyo, Japan

[21] Appl. No.: 336,138

[22] Filed: Apr. 11, 1989

[30] Foreign Application Priority Data

Apr. 13, 1988 [JP] Japan ..... 63-92291
Jan. 6, 1989 [JP] Japan ..... 1-1590

[51] Int. Cl.[5] ..... B41M 5/26

[52] U.S. Cl. ..... 428/409; 428/195; 428/474.4; 428/480; 428/500; 428/913; 428/914

[58] Field of Search ..... 428/195, 474.4, 480, 428/913, 914, 409, 500

[56] References Cited

FOREIGN PATENT DOCUMENTS 56-164891 12/1981 Japan ..... 428/195
60-101083 6/1985 Japan ..... 428/195
60-101084 6/1985 Japan ..... 428/195

OTHER PUBLICATIONS

Japanese Standards Association, "Method for Measurement for Specular Glossiness", Japanese Industrial Standard, JIS Z 8741-1983, UDC 535.361.21, pp. 1-8 and translation.

*Primary Examiner*—Pamela R. Schwartz
*Attorney, Agent, or Firm*—Cushman, Darby & Cushman

[57] ABSTRACT

A thermal transfer recording sheet comprising a substrate and a hot-melt ink containing layer coated on one side of the substrate, said hot-melt ink layer comprising materials which cause cohesive failure by heat at the time of transfer, which thermal transfer recording sheet can give lusterless mat-type letters.

12 Claims, 2 Drawing Sheets

EXAMPLE 13 (INK-COATED SURFACE)

COMPARETIVE EXAMPLE 5 (INK-COATED SURFACE)

THERMAL TRANSFER RECORDING SHEET

BACKGROUND OF THE INVENTION

1. Field of the Invention

This invention relates to a thermal transfer recording sheet which gives lusterless, mat-type printed letters. More particularly, it relates to a thermal transfer recording sheet which give mat-type printed letters, is excellent in the adherence of substrate between ink, and gives a high-quality printed image.

2. Related Art Statement

In recent years, there has been energetically developed thermal transfer recording in which transferred images are formed on ordinary paper by means of a thermal printer, a thermal facsimile telegraph, or the like. The thermal transfer recording are recently widely used, for example, for the following reasons. Since apparatuses for the thermal transfer recording have a simple mechaniam, their maintenance is easy and their prices and maintenance costs are low. The thermal transfer recording permits clear and fast recording by means of low energy. The thermal transfer recording makes it possible to conduct color printing relatively easily by the use of a multicolor ink sheet.

In particular, the amount of consumption of monochromatic type thermal transfer recording sheet is increased owing to the spread of thermal printers for word processor, thermal facsimile telegraphs, etc.

However, images printed by a thermal printer are generally highly lustrous. In the case of multicolor recording, not only precision but also beauty of recording are required, for example, for graphic design and full-color copying, and the gloss of image contributes greatly to these characteristics.

On the other hand, monochromatic printing is often utilized, for example, for printing and duplication of letters. In this case, in reading a printed image, the higher its gloss, the more the eye fatigue of a reader. This is one of points in which the thermal transfer recording is desired to be improved. That is, lusterless mat-type printed letters are eagerly desired.

Under such conditions, as to thermal transfer recording which yields lusterless mat-type printed letters, there are a large number of prior arts.

For example, Jap. Pat. Appln. Kokai (Laid-Open) No. 60-101084 discloses a method in which a matting effect is obtained by subjecting to sandblasting treatment the surface of a base film on which a hot-melt ink layer is to be formed, or by kneading fine particles together with other materials and forming the resulting mixture to a film.

Jap. Pat. Appln. Kokai (Laid-Open) No. 56-164891 discloses a method in which a delustering agent is included in a hot-melt heat-sensitive ink.

Furthermore, Jap. Pat. Appln. Kokai (Laid-Open) No. 60-101083 discloses a method in which a matting layer is formed on a base film.

In addition to them, there is exemplified Jap. Pat. Appln. Kokai (Laid-Open) No. 62-260390 which discloses a dye transfer type thermal printing sheet capable of giving an intermediate tone. This dye transfer type thermal printing sheet comprises a resin A having a high adhesive strength to substrate and a resin B having a low adhesive strength to substrate. In this reference, when the substrate is a polyester film, as the resin A, there is exemplified at least one member selected from the group consisting of saturated polyesters, ethylene-vinyl acetate copolymer resins and silicone resins. And as the resin B, there is exemplified at least one member selected from the group consisting of vinyl chloride-vinyl acetate copolymer resins, vinyl acetate resins, acrylonitrile-phenol copolymer resins and acrylonitrile-styrene copolymer resins. However, the invention of this reference is intended to provide a dye transfer type thermal printing sheet having a high image quality and a high fixability and is characterized in that it was made by noting the fixation due to wear of the printing sheet on an image-receiving sheet after transfer. That is, in the case of the dye transfer type thermal printing sheet of the reference, both the resin A and the resin B are peeled off from the substrate, while a high fixability is imparted. Furthermore, in said reference, an image printed by transfer has an intermediate color tone, and in the examples described in said reference, ink is coated by the use of a solvent in all cases.

The prior arts of the references cited above involve various problems.

For example, the method of subjecting the surface of a base film to sandblasting treatment has defects such as a lowering of the strength of the film itself and a high cost. The method of kneading fine particles together with other materials and forming the resulting mixture into a film is disadvantageous in that a large matting effect cannot be obtained unless a large amount of the fine particles are kneaded together with other materials.

The method of including a delustering agent in ink has the following defect. The delustering agent is generally an inorganic pigment. When it is included in a small amount, a matting effect is difficult to obtain. On the other hand, when it is included in a large amount, the print quality and the transfer density are lowered.

In addition, the method of forming a matting layer on a base film has the following defect. The ink used in the matting layer is a material composed of a binder and an inorganic pigment, and in order to obtain a matting effect, the depth to which the matting effect extends in the matting layer should be increased, so that the particle size or the using amount of the inorganic pigment should be increased.

SUMMARY OF THE INVENTION

The present invention removes the defects of prior arts and provides a thermal transfer recording sheet which gives lusterless mat-type printed letters.

That is, the thermal transfer recording sheet of this invention is characterized in that (1) after thermal transfer, its hot-melt ink undergoes cohesive failure at the time of peeling off the thermal transfer sheet from an image-receiving sheet, or (2) the hot-melt ink comprises two or more resins incompatible or partially compatible with one another, which form an island-sea structure, i.e., a nonuniformly mixed state in which the resins in the hot-melt ink have undergone micro-phase separation, and which resins thus constitutes the island phase and the sea phase, respectively, and the island phase is selectively left in the substrate to give lusterless mat-type printed letters.

Furthermore, the present invention is directed to a thermal transfer recording sheet which gives a mat-type printed image in combination with an image-receiving sheet by thermal transfer recording. The present invention is further directed to a thermal transfer recording sheet for which said mat-type printed image has a 60° specular gloss (hereinafter abbreviated as "glossiness")

of 30 or less as measured according to the specular gloss measuring method specified in JIS Z8741.

DETAILED DESCRIPTION OF THE DRAWINGS

Figure 1:
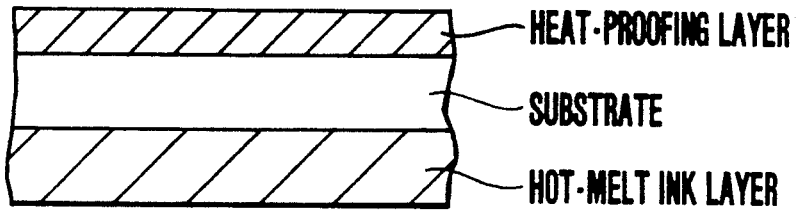
Figure 2:
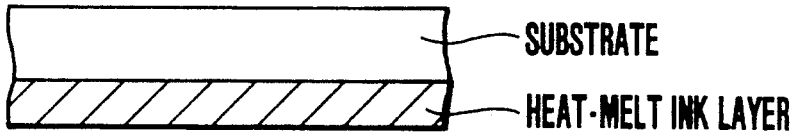

FIGS. 1 and FIG. 2 show the structures of the thermal transfer recording sheets of the present invention. In FIG. 1, a heat-proofing layer is provided on the side reverse to a substrate. In FIG. 2, no heat-proofing layer is provided.

Figure 3:
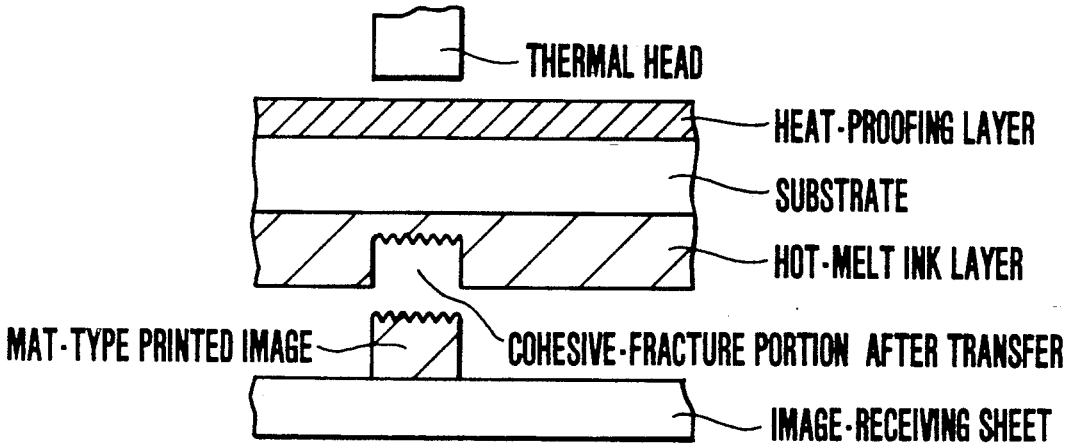
Figure 4:
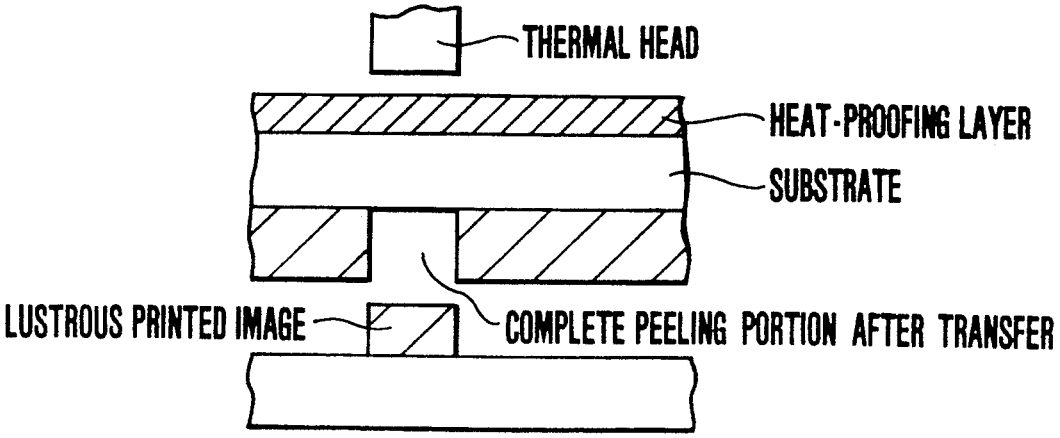

FIGS. 3 and FIG. 4 are structure diagrams in the case of transfer to an image-receiving sheet by means of a thermal head. In FIG. 3, the mat-type printed image according to the present invention are given. In FIG. 4, a conventional lustrous printed image is given.

Figure 5:
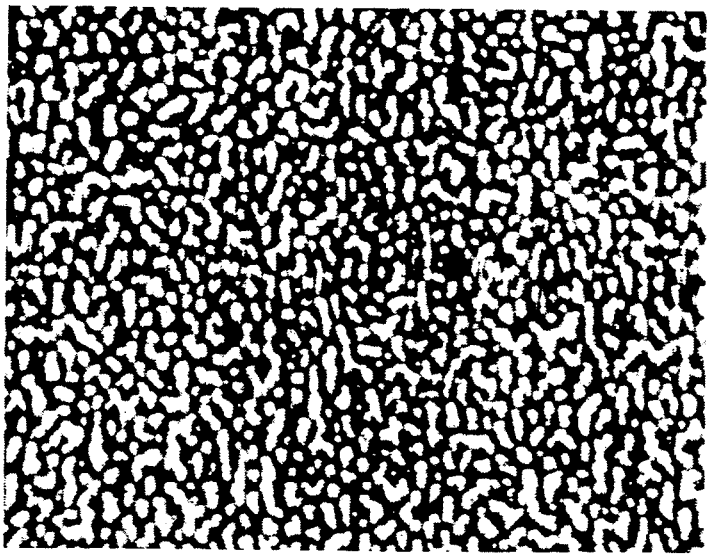
Figure 6:
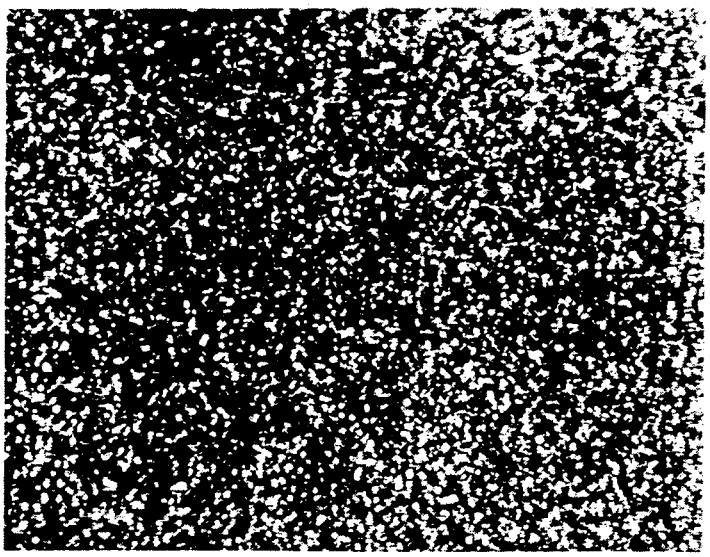

FIGS. 5 and FIG. 6 show micrographs (400x) of the ink-coated surfaces of the thermal transfer recording sheets obtained in Example 13 and Comparative Example 5, respectively. In FIG. 5 and FIG. 6, the white portions show a resin in island phase and the black portion a resin in sea phase. In FIG. 5, it is clear that there is formed the island-sea structure according to the present invention in which micro-phase separation has occurred. On the other hand, in FIG. 6, the formation of the island-sea structure is insufficient.

DETAILED DESCRIPTION OF PREFERRED EMBODIMENTS

The present invention is specifically exaplained below.

The thermal transfer recording sheet of the present invention comprises a substrate and a hot-melt ink layer coated on one side of the substrate. When printing is conducted by using said thermal transfer recording sheet in combination with an image-receiving sheet, the thermal transfer recording sheet gives a lusterless mat-type printed image on the image-receiving sheet. That is, the thermal transfer recording sheet of the present invention is intended to give a lusterless mat-type printed image. The achievement of the above object is considered to be deeply affected by the state of the interface between the substrate and the hot-melt ink coated thereon of the thermal transfer recording sheet.

In conventional thermal transfer recording, a hot-melt ink coated on a substrate is completely peeled off from the substrate and transferred to an image-receiving sheet. In this case, since the substrate generally has a highly smooth surface like a mirror surface, a printed image obtained by the transfer to the image-receiving sheet is lustrous, reflecting the state of surface of the substrate faithfully. One method for attaining a mat-type printing properties on the basis of the above fact is the method of forming a matting layer on a substrate disclosed in the aforesaid reference Jap. Pat. Appln. Kokai (Laid-Open) No. 60-101083. According to this method, mat-type printed letters are obtained by reproducing the state of the matting layer on the surface of printed image.

In contrast with such a method, in the first aspect of the present invention, at the time of peeling off the thermal transfer recording sheet from an image-receiving sheet after thermal printing, cohesive failure of the hot-melt ink itself (fracture peeling between the thermal transfer recording sheet and the image-receiving sheet) is caused, but not complete peeling between the substrate surface and the hot-melt ink of the thermal transfer recording sheet. Thus, a printed image is obtained by transfer which has a surface of mat type due to the fracture peeling. In this case, the adhesive strength between the substrate and the hot-melt ink layer contributes greatly to fracture peeling which is caused between the thermal transfer recording sheet and the image-receiving sheet without disturbing the printed image.

The term "adhesive strength" used herein means the adhesive strength in terms of g/25 mm measured by a measuring method according to the 180° peel adhesive strength test method specified in JIS K6854. The 180° peel adhseive strength test method comprises coating a hot-melt material on a test piece in an amount of 130 to 180 g/m$^2$, attaching the coated surface of the test piece (substrate) to another test piece, applying a load of 5 kg to the substrates by means of a hand roller, pressing them in the longitudinal direction 5 times repeatedly without return, allowing them to stand at ordinary temperature for 48 hours, and then subjecting them to 180° peeling at a movement rate of 200±20 mm/min by means of a load cell type peel tester.

In the first aspect of the present invention, the adhesive strength is measured in accordance with the above test method. Specifically, the substrate is coated with the hot-melt ink, and the coated surface is attached to the same substrate as described above which has not been coated. The substrates are pressed at a prescribed load and allowed to stand in a 120° C. atmosphere for 10 minutes. After the bonding, the resulting assembly is allowed to stand at room temperature for 10 minutes and then slit into pieces of 25 mm in width, which are used as test pieces.

When the hot-melt ink of a thermal transfer recording sheet has an adhesive strength to substrate in the range of 50 to 500 g/25 mm when hot (80° C.) in the case where it is tested by the above test method, it can give the lusterless mat-type printed letters of the present invention. That is, when the adhesive strength is in the specified range, cohesive failure of the ink itself can be caused between the substrate and the hot-melt ink, as described above. Among main materials for hot-melt ink, one which is deeply involved in control of the adhesive strength is fundamentally hot-melt materials. Although any hot-melt materials are fit for the object of the first aspect of the present invention so long as they have a high adhesive strength to substrate, hot-melt materials obtained by using as resin material, dimer acid-based polyamide resins or saturated polyester resins are particularly preferably in the first aspect. These resins are adhesive to substrates, and the higher their molecular weight, the higher their adhesive strength. However, when their adhesive strength is too high, the effect of thermal transfer recording is inhibited. Resins having a particularly high adhesive strength have not only a high molecular weight but also a high softening point and a high melting viscosity, and hence are not desirable.

For preparing a hot-melt material having such an adhesive strength as described above, a wax(es) and a metal soap(s) are mixed with resins which are important factors governing the adhesive strength to substrate, by a conventional method. However, as the resins which are important factors governing the adhesive strength to substrate, there should be chosen and used resins capable of having, as described above, an adhesive strength in the range of 50 to 500 g/25 mm when hot (80° C.). Although the molecular weight of such resins varies depending on the kind of resin, a combined use of a resin having a low molecular weight of less than 3,000–4,000 and a resin having a relatively high molecular weight of not more than 25,000–30,000 and not less than 3,000–4,000 results in a desired adhesive strength.

As preferable combinations, there may be exemplified combinations of a polyamide resin having a molecular weight of less than 4,000 and a polyamide resin having a molecular weight of 4,000–30,000, and combinations of a saturated polyester resin having a molecular weight of less than 3,000 and a saturated polyester resin having a molecular weight of 3,000–25,000. Needless to say, it is also possible to use a mixture obtained by adding a third resin in such an amount that the adhesive strength is kept in the above range.

More preferable combinations are as follows. In the case of the above polyamide resins, there may be exemplified combinations of 10–80 parts by weight of a polyamide resin having a molecular weight of less than 4,000 and 10–60 parts by weight of a polyamide resin having a molecular weight of 4,000–30,000. In the case of the saturated polyester resins, there may be exemplified combinations of 10–60 parts by weight of a polyester resin having a lower molecular weight of less than 3,000 and 10–50 parts by weight of a polyester resin having a higher molecular weight of 3,000–25,000.

The combined use of resins having such two molecular weights as described above contributes to lowering of the compatibility of the resins of the same type with each other and lowering of the softening point and the melting viscosity of hot-melt ink. It is preferable also in this point. The softening point and the melting viscosity of hot-melt ink are involved in the workability during production of hot-melt ink and the transferability of thermal transfer recording sheet. Thus, they are important factors.

Cases where the adhesive strength of the hot-melt ink of the present aspect is outside the range specified above can be explained as follows. When the adhesive strength is less than the lower limit, i.e., 50 g/25 mm, peeling-off of the hot-melt ink from a substrate is easy and no cohesive failure occurs. That is, the surface of substrate is faithfully reproduced, resulting in a lustrous printed image. Thus, such an adhesive strength is not fit for the object of the present invention, the mat-type printed letters.

When the adhesive strength is higher than the upper limit, i.e., 500 g/mm, peeling-off of the hot-melt ink from a substrate becomes difficult, so that the transferability to image-receiving sheet is lowered, and the degree of cohesive failure of the hot-melt ink is heightened, and a printed image is obtained which is in the state of excessively mat type printed letters, namely, in the state of chipped letters or ink-missing.

Whether cohesive failure occurs or not can be judged, for convenience, by investigating the portion of peeling of the hot-melt ink layer of a thermal transfer recording sheet after transfer. When the cohesive failure according to the first aspect of the present invention has occurred, the hot-melt ink remains on the substrate irregularly. When the hot-melt ink remains in excess, its transfer to an image-receiving sheet is insufficient, resulting in inferior printing properties and a low transfer density. A desirable degree of remaining is such that a slight amount of the hot-melt ink is uniformly left on the substrate. On the other hand, when the hot-melt ink remains on the substrate in a hardly detectable amount, for example, in the case where a transparent substrate such as polyester film is used, most of the hot-melt ink is transferred to an image-receiving sheet from the surface of substrate and the printed image obtained by the transfer is a lustrous one, reflecting the state of surface of the substrate faithfully. Therefore, such a small amount is not desirable.

The second aspect of the present invention is directed to obtaining desired lusterless mat-type printed letters by using a hot-melt ink comprising two or more resins which are incompatible or partially compatible with each other, forming an island-sea structure, i.e., a nonuniformly mixed state in which said resins in the hot-melt ink have undergone microphase separation, and causing cohesive peeling.

Although the reason why the lusterless mat-type letters are thus obtained is not apparent, we conjecture as follows. The resin which forms the island phase should be excellent in adhesion to a polyester film as substrate, while the resin which forms the sea phase should be excellent in adhesion to an image-receiving sheet. When such resins are used, the ink melted by heat from a thermal head undergoes phase separation in the vicinity of the interface between the ink and the substrate, resulting in a state in which the island phase resin excellent in adhesion to the substrate has been selectively moved to the substrate side, namely, resulting in an nonuniform interface in the so-called ink layer. Consequently, peeling occurs on the nonuniform interface in the ink layer when the thermal transfer recording sheet is peeled off after printing by heating from an image-receiving sheet on which the recording sheet have been placed. As a result, a portion of the thermal transfer recording sheet to which portion heat has been applied, namely, the portion in which peeling (cohesive failure) has occurred, falls into a so-called roughened surface state in which said portion has irregular depressions and protuberances. Thus, the printed surface is matted. In addition, fine depression and protuberances of the island phase resin left on the substrate also seems to promote the matting of the printed surface.

In the second aspect, on such a principle, the thermal transfer recording sheet of the present invention can give lusterless mat-type printed letters.

As a material which constitutes the island phase, although any hot-melt material having a high adhesive strength to substrate is fit for the object of the present invention, saturated polyester resins and dimer acid-based polyamide resins are particularly preferable in the present aspect. These resins are adhesive to the substrate. The higher their molecular weight, the higher their adhesive strength. But the higher their molecular weight, the higher their softening point and melting viscosity and the more difficult the formation of the island-sea structure, i.e., a nonuniformly mixed state in which the resins have undergone micro-phase separation in the hot-melt ink.

In the hot-melt ink used in the second aspect of the present invention, the resin which forms the island phase is preferably a saturated polyester resin or a dimer acid-based polyamide resin which has a melting viscosity at 120° C. of 50 poise or less. In this case, the resin which forms the sea phase is preferably at least one member selected from the group consisting of olefin resins such as polyethylenes, polypropylenes and polybutenes, and derivatives thereof from the viewpoint of the compatibility, melting viscosity and softening point.

As described above, when the resin which forms the island phase is a saturated polyester resin having a melting viscosity at 120° C. of 50 poise or less, the resin which forms the sea phase is at least one member selected from the group consisting of olefin resins such as polyethylenes, polypropylenes and polybutenes, and derivatives thereof. Said hot-melt ink is prepared so as to contain 10 to 40% by weight of said saturated polyester resin and 40 to 70% by weight of said olefin resin.

When the resin which forms the island phase is a dimer acid-based polyamide resin having a melting viscosity at 120° C. of 50 poise or less, the resin which forms the sea phase is at least one member selected from the group consisting of olefin resins such as polyethylenes, polypropylenes and polybutenes, and derivatives thereof. Said hot-melt ink is preferably prepared so as to contain 10 to 40% by weight of said polyamide resin and 40 to 70% by weight of said olefin resin.

More specific examples of the resins which form the island phase and the sea phase, respectively, include polyamide resins, polyester resins, epoxy resins, polyurethane resins, acrylic resins, polyvinyl resins, polyvinyl chloride resins, cellulose resins, polyvinyl alcohol resins, petroleum resins, terpene resins, polystyrene resins, polyolefin resins, and elastomers. As resins fit for the object of the present invention, saturated polyester resins, polyamide resins, and olefin resins or derivatives thereof are particularly preferable.

Cases where the blending amounts of the resins for the hot-melt ink of the present aspect is outside the range specified above can be explained as follows. When the blending amount of the resin for island phase is less than 10% by weight, the lower limit, this resin moves to the substrate side in a small absolute amount during printing by heating, resulting in insufficient formation of a nonuniform interface, and hence no cohesive failure occurs. That is, the surface of substrate is reproduced as it is, and hence a lustrous printed image is formed. Therefore, such a blending amount is not fit for the object of the present invention, the mat-type printed letters. On the other hand, when the blending amount of the resin for island phase is more than 40% by weight, i.e., the upper limit, the melting viscosity of the whole ink is increased and the adhesion between the hot-melt ink and the substrate is excessive. Therefore, when the thermal transfer recording sheet is peeled off from an image-receiving sheet after printing by heating, cohesive failure has occurred in the ink layer, but the amount of the ink remaining on the thermal transfer recording sheet after the peeling is large, resulting in a marked lowering of the print quality.

In the present invention, a printed image obtained by thermal transfer recording by using a combination of the thermal transfer recording sheet and an image-receiving sheet is desired to be a mat-type printed image having a 60° specular gloss of 30 or less as measured by the specular gloss measuring method specified in JIS Z8741. When the 60° specular gloss is more than 30, the printed image obtained is not the mat-type printed image aimed at by the present invention, and tends to tax the eyes.

Next, materials used and the like are more specifically explained below.

As the substrate, there may be used thin papers such as condenser paper, typewriter paper, tracing paper and the like, synthetic paper, cellophane paper, and synthetic resin films such as polyester film, polyimide film, polyethylene film, polycarbonate film, Teflon film and the like. They may be used as they are or after being subjected to heat-proofing treatment so as not to adhere to a thermal head.

Among them, polyester film is particularly preferable for the object of the present invention.

In the thermal transfer recording sheet of the present invention, as main hot-melt materials for the hot-melt ink, polyamide resins and saturated polyester resins are preferred as described above, and the various materials described below may be used alone or in combination of two or more thereof so long as the adhesive strength of the hot-melt ink is in the range specified in the present invention.

The hot-melt ink used in the present invention comprises hot-melt materials, colorants, binders, softeners, etc. Hot-melt inks comprising these materials may be properly used depending on the way of use, etc.

The hot-melt materials include the waxes, metal soaps and resins exemplified below, but are not limited thereto.

The waxes include, for example, vegetable waxes such as rice wax, Japan wax, candelilla wax, carnauba wax and the like; animal waxes such as lanolin, beeswax, spermaceti, shellac wax and the like; mineral waxes such as montan wax, ozocerite, ceresine and the like; petroleum waxes such as paraffin wax, microcrystalline wax and the like; synthetic hydrocarbon waxes such as oxidized paraffin wax, low-molecular-weight polyethylenes, and the like; and fatty acid amide waxes such as ricinolic acid amide, lauric acid amide, erucic acid amide, palmitic acid amide, oleic acid amide, stearic acid amide, ethylenebisstearic acid amide and the like.

The metal soaps include metal salts of higher fatty acids, such as sodium stearate, sodium palmitate, potassium laurate, potassium myristate, potassium stearate, zinc stearate, aluminum stearate, magnesium stearate, and the like.

As the resins, in addition to resins having the previously described characteristics, there may, if necessary, be properly chosen and used, for example, polyamide resins, polyester resins, epoxy resins, polyurethane resins, acrylic resins, polyvinyl resins, polyvinyl chloride resins, cellulose resins, polyvinyl alcohol resins, petroleum resins, terpene resins, polystyrene resins, polyolegin resins, and elastomers.

The colorants include dyes and pigments, for example, oil-soluble dyes, disperse dyes and color pigments. These dyes and pigments may be chosen and used if necessary.

Specific examples of the colorants are given below, but the colorants are not limited thereto. The dyes and pigments described below may be used alone or in combination two or more thereof.

The oil-soluble dyes include azo dyes, azo metal complex dyes, anthraquinone dyes and phthalocyanine dyes. More specifically, the azo dyes include Solvent Yellow 2 (C.I. 11020, hereinafter the number in each parenthesis is C.I. No.), Solvent Orange 1 (11920), solvent Red 24 (26105), Solvent Brown 3 (11360), etc. The azo metal complex dyes include Solvent Yellow 19 (13900A), Solvent Orange 5 (18745A), Solvent Red 8 (12715), Solvent Brown 37, Solvent Black 123 (12195), etc. The anthraquinone dyes include Solvent Violet 13 (60725), Solvent Blue 11 (61525), Solvent Green 3 (61565), etc. The phthalocyanine dyes include Solvent Blue 25 (74350), etc.

The disperse dyes include aminoazo or aminoanthraquinone dyes, nitroarylamine dyes, etc. More specifically, the aminoazo dyes include Disperse Yellow 3 (C.I. 11855, hereinafter the number in each parenthesis is C.I. No.), Disperse Orange 3 (11005), Disperse Red 1

(11110), Disperse Violet 24 (11200), Disperse Blue 44, etc. The aminoanthraquinone dyes include Disperse Orange 11 (60700), Disperse Red 4 (60755), Disperse Violet 1 (61100), Disperse Blue 3 (61505), etc.

The nitroarylamine dyes include Disperse Yellow 1 (10345) and 42 (10338), etc.

The color pigments include azo dyes (monoazo, bisazo, and condensed azo dyes), dyeing lake pigments (acid dye lake, basic dye lake, and mordant dye lake pigments), nitro pigments, nitroso pigments, phthalocyanine pigments, higher pigments (vat dye type pigments, metal complex pigments, perylene pigments, isoindolynone pigments, and quinacridone pigments), etc. More specifically, the azo dyes include, for example, monoazo dyes such as Hanza Yellow G (C.I. 11680, hereinafter the number in each parenthesis is C.I. No.), Hanza Yellow R (12710), Pyrazolone Red B (21120), Permanent Red R (12085), Lake Red C (15585), Brilliant Carmine 6B (15850) and Permanent Carmine FB (12490); bisazo pigments such as Benzidine Yellow G (21090), Benzidine Yellow GR (21100) and Permanent Yellow NCR (20040); and condensed azo pigments such as Chromophthal Yellow and Chromophthal Red. The dyeing lake pigments include, for example, acid dye lakes such as Quinoline Yellow Lake (47005), Eosine Lake (45380) and Alkali Blue Lake (42750A and 42770A); basic dye lake pigments such as Rhodamine Lake B (45170), Methyl Violet Lake (42535), Victoria Blue Lake (44045) and Malachite Green Lake (42000); and mordant dye lake pigments such as Alizalin Lake (58000). The nitro pigments include Naphthol Yellow S (10316), etc. The nitroso pigments include Pigment Green B (10006), Naphthol Green B (10020), etc. The phthalocyanine pigments include metal-free phthalocyanine Blue (74100), Phthalocyanine Blue (74160), Phthalocyanine Green (74260), etc. The higher pigments include, for example, vat dye type pigments such as Anthrapyrimidine Yellow (68420), Indranthrene Brilliant Orange GK (59305), Indanthrene Blue RS (69800) and Thioindigo Red B (73300); metal complex pigments such as Nickel Azo Yellow (12775); perylene pigments such as Perylene Red (71140) and Perylene Scarlet (71137); isoindolynone pigments such as Isoindolynone Yellow; and quinacridone pigments such as Quinacridone Red Y (46500) and Quinacridone Magenta (73915).

The color pigments also include black pigments such as carbon black (C.I. 77265).

As the binders, either water-soluble binders or water-insoluble binders can be used.

Specified examples of the binders are given below, but the binders are not limited thereto. The binders described below may be used alone or in combination of two or more thereof.

The binders include, for example, polyvinyl alcohols, methyl cellulose, gelatin, hydroxyethyl cellulose, carboxymethyl cellulose, gum arabic, starch and its derivatives, casein, polyvinyl pyrrolidones, butyral resins, ethylene ethylacrylate, styrene-butadiene copolymers, vinyl acetate resins, vinyl acetate series copolymers, acrylic resins, methyl methacrylate resins, styrene-acrylonitrile resins, ethylene-vinyl acetate copolymers, polyester resins, petroleum resins, etc.

The softeners include mineral oil, dibutyl phthalate, dioctyl phthalate, mineral spirit, liquid paraffin, etc.

In addition to the above-mentioned hot-melt materials, colorants, binders and softeners, there may be added additives such as surfactants, dispersants, antistatic agents, antioxidants, ultraviolet absorbers, etc.

As a coating machine used for coating the hot-melt ink of the present invention to a substrate, there may be exemplified conventional coaters such as hot-melt coater, air knife coater, roll coater, blade coater, bar coater, and the like, and conventional printing machines for flexographic printing, gravure printing, etc.

For solvent coating, ordinary solvents can be used. There can be properly chosen and used, for example, methanol, ethanol, isopropanol, toluene, methyl ethyl ketone, acetone, and ethyl acetate.

The coating thickness of the hot-melt ink layer is 1 to 15 μm, preferably 2 to 10 μm, more preferably 3 to 6 μm.

The thermal transfer recording sheet of the first aspect of the present invention comprises a substrate and a hot-melt ink layer coated on one side of the substrate, and is characterized in that the adhesive strength of the hot-melt ink measured by the 180° peel adhesive strength test specified in JIS K6854 is 50–500 g/25 mm when hot (80° C.) between the substrate and the hot-melt ink.

It is further characterized in that hot-melt materials as main constituents of the hot-melt ink comprise two dimer acid-based polyamide resins having molecular weights of less than 4,000 and 4,000–30,000, respectively, or two saturated polyester resins having molecular weights of less than 3,000 and 3,000–25,000, respectively.

The thermal transfer recording sheet of the present invention having these characteristics makes it possible to obtain a lusterless mat-type printed image by thermal transfer recording by combining the thermal transfer recording sheet and an image-receiving sheet.

The thermal transfer recording sheet of the second aspect of the present invention comprises a substrate and a hot-melt ink layer coated on one side of the substrate, and is characterized in that the hot-melt ink comprises two or more resins incompatible or patially compatible with each other, which form an island-sea structure, i.e., a nonuniformly mixed state in which the resins in the hot-melt ink have undergone micro phase separation.

The thermal transfer recording sheet of the present invention having this characteristic makes it possible to obtain a mat-type printed image having a low glossiness on an image-receiving sheet. Moreover, it is excellent in the adherence of the substrate between the ink and can give a printed image of high quality.

EXAMPLES

The present invention is concretely illustrated with the following examples. In the examples, parts and percents are all by weight.

EXAMPLE 1

A hot-melt ink was prepared from polyamide resins having molecular weights of 1,000 and 5,000, respectively, according to the recipe shown below by means of a sand mill. The hot-melt ink was coated on the uncoated surface of a polyester film of 5.4 μm in thickness having a heat-proofing layer coated on one side, to a thickness of 4 μm by means of a hot-melt coater, whereby a thermal transfer recording sheet was obtained.

| | |
|---|---|
| Polyamide resin (molecular weight: 1,000) | 30 parts |
| Polyamide resin (molecular weight: 5,000) | 30 parts |
| Stearic acid amide (melting point: 100° C.) | 30 parts |
| Carbon black | 10 parts |

The thermal transfer recording sheet thus obtained was placed on an image-receiving sheet (TTR-T, a trade name, mfd. by Mitsubishi Paper Mills, Ltd.), and printing of a letter pattern and solid printing were conducted at an applied energy of 1.2 mJ/dot by means of a printing tester (a thermal head printer mfd. by Matsushita Electronic Parts Co.). When the thermal transfer recording sheet was peeled off from the image-receiving sheet, it was confirmed that the melt-hot ink which had undergone cohesive failure remained in a portion of the thermal transfer recording sheet which portion had been subjected to thermal printing. The adhesive strength (g/25 mm) between the substrate and the hot-melt ink of the thermal transfer recording sheet was previously measured as 181 g/25 mm by the method according to 180° peel adhesive strength test method specified in JIS K6854.

The resulting solid print and letter pattern on the image-receiving sheet were lusterless mat-type printed letters. For the solid print, the 60° specular gloss in accordance with the specular gloss measuring method specified in JIS Z8741 was 11.5 as measured by means of a glossmeter (VGS-101 DP, a trade name, mfd. by Nihon Denshoku Kogyo Co.).

EXAMPLE 2

A thermal transfer recording sheet was produced in the same manner as in Example 1, except that a polyamide resin having a molecular weight of 10,000 was used in place of the polyamide resin having a molecular weight of 5,000. The results of evaluation in the same manner as in Example 1 are shown in Table 1.

COMPARATIVE EXAMPLE 1

A thermal transfer recording sheet was produced in the same manner as in Example 1, except that, of the polyamide resins used in Example 1, the polyamide resin having molecular weight 5,000 was omitted and only the resin having a molecular weight of 1,000 was used in an amount of 60 parts. It was evaluated in the same manner as in Example 1. The results obtained are shown in Table 1.

EXAMPLE 3

Polyamide resins having molecular weights of 2,000 and 8,000, respectively, were dissolved in iso-propanol, and a hot-melt ink was prepared according to the recipe shown below. The hot-melt ink was coated on the uncoated surface of a polyester film of 5.4 μm having a heat-proofing layer coated on one side, to a thickness of 4 μm by means of a gravure coater, whereby a thermal transfer recording sheet was obtained.

| | |
|---|---|
| Polyamide resin (molecular weight: 2,000) | 20 parts |
| Polyamide resin (molecular weight: 8,000) | 40 parts |
| Microcrystalline wax (melting point: 70° C.) | 30 parts |
| Carbon black | 10 parts |
| Iso-propanol | 200 parts |

The thermal transfer recording sheet thus obtained was evaluated in the same manner as in Example 1. The results obtained are shown in Table 1.

EXAMPLE 4

A thermal transfer recording sheet was produced in the same manner as in Example 3, except that a polyamide resin having a molecular weight of 20,000 was used in place of the polyamide resin having a molecular weight of 8,000. It was evaluated in the same manner as in Example 1. The results obtained are shown in Table 1.

COMPARATIVE EXAMPLE 2

A thermal transfer recording sheet was produced in the same manner as in Example 1, except that, of the polyamide resins used in Example 3, the polyamide resin having a molecular weight of 2,000 was omitted and only the polyamide resin having a molecular weight of 20,000 was used in an amount of 60 parts. It was evaluated in the same manner as in Example 1. The results obtained are shown in Table 1.

EXAMPLE 5

A hot-melt ink was prepared from polyester resins having molecular weights of 2,000 and 7,000, respectively, according to the recipe shown below by means of a sand mill. The hot-melt ink was coated on the uncoated surface of a polyester film of 5.4 μm in thickness having a heat-proofing layer coated on one side, to a thickness of 4.5 μm, whereby a thermal transfer recording sheet was obtained.

| | |
|---|---|
| Polyester resin (molecular weight: 2,000) | 40 parts |
| Polyester resin (molecular weight: 7,000) | 20 parts |
| Oxidized paraffin wax (melting point: 83° C.) | 30 parts |
| Carbon black | 10 parts |

The thermal transfer recording sheet hus obtained was evaluated in the same manner as in Example 1. The results obtained are shown in Table 1.

EXAMPLE 6

A thermal transfer recording sheet was produced in the same manner as in Example 5, except that a polyester resin having a molecular weight of 10,000 was used in place of the polyester resin having a molecular weight of 7,000. It was evaluated in the same manner as in Example 1. The results obtained are shown in Table 1.

COMPARATIVE EXAMPLE 3

A thermal transfer recording sheet was produced in the same manner as in Example 5, except that there was employed the recipe shown below in which, of the polyester resins used in Example, the polyester resin having a molecular weight of 7,000 was omitted and only the polyester resin having a molecular weight of 2,000 was used. It was evaluated in the same manner as in Example 1. The results obtained are shown in Table 1.

| | |
|---|---|
| Polyester resin (molecular weight: 2,000) | 40 parts |
| Oxidized paraffin wax (melting point: 83° C.) | 50 parts |
| Carbon black | 10 parts |

EXAMPLE 7

Polyester resins having molecular weights of 2,000 and 10,000, respectively, were dissolved in a mixed solvent of toluene and methyl ethyl ketone in the ratio of 8:2, and a hot-melt ink was prepared according to the recipe shown below. The hot-melt ink was coated on the uncoated surface of a polyester film of 5.4 μm in thickness having a heat-proofing layer coated on one side, to a thickness of 4.5 μm by means of a gravure coater, whereby a thermal transfer recording sheet was obtained.

| | |
|---|---|
| Polyester resin (molecular weight: 2,000) | 20 parts |
| Polyester resin (molecular weight: 10,000) | 40 parts |
| Polystyrene (melting point: 75° C.) | 30 parts |
| Carbon black | 10 parts |

The thermal transfer recording sheet thus obtained was evaluated in the same manner as in Example 1. The results obtained are shown in Table 1.

EXAMPLE 8

A thermal transfer recording sheet was produced in the same manner as in Example 7, except that a polyester resin having a molecular weight of 25,000 was used in place of the polyester resin having a molecular weight of 10,000. It was evaluated as in Example 1. The results obtained are shown in Table 1.

COMPARATIVE EXAMPLE 4

A thermal transfer recording sheet was produced in the same manner as in Example 7, except that, of the resins used in Example 7, the polyester resin having a molecular weight of 2,000 was omitted and only the polyester resin having a molecular weight of 25,000 was used in an amount of 60 parts. It was evaluated in the same manner as in Example 1. The results obtained are shown in Table 1.

The following evaluation methods were employed.

1) Adhesive strength

The adhesive strength (g/25 mm) between substrate and hot-melt ink at a high temperature (80° ) was measured according to the 180° peel adhesive strength test method specified in JIS K6854.

In preparing a sample, hot-melt ink was coated on a substrate, immediately after which the coated surface was attached to an uncoated substrate. Then, the substrates were bonded to each other by pressing at a prescribed load and allowed to stand in 120° C. atmosphere for 10 minutes. After being thus joined to each other, the substrates were allowed to stand at room temperature for 10 minutes. The assembly thus obtained was slitted into pieces having a width of 25 mm. These pieces were used as test pieces.

2) 60° Specular gloss

The 60° specular gloss in accordance with the specular gloss measuring method specified in JIS Z8741 was measured by means of a glossmeter (VGS-1001DP, a trade name, mfd. by Nihon Denshoku Kogyo Co.). An image-receiving sheet (TTR-T, a trade name, mfd. by Mitsubishi Paper Mills Ltd.) and a thermal transfer recording sheet were placed one upon another, and solid printing was conducted by means of a printing tester (a thermal head printer mfd. by Matsushita Electronic Parts Co.). The solid print portion thus obtained by transfer was used.

3) Printing properties

A letter pattern and a solid print portion which were obtained by printing on the aforesaid image-receiving sheet were observed with the naked eye.

The result obtained was expressed by ○ and X as follows:

○: A clear print was given without ink-missing and blur.

X: Many ink-missing and blurs were observed.

4) Cohesive failure

In each thermal transfer recording sheet used for solid printing on the aforesaid image-receiving sheet, the portion where the hot-melt ink had been peeled off was observed with the naked eye. The state in which the hot-melt ink remained was expressed by "occurred" (cohesive failure occurred), and the transparent state in which the hot-melt ink did not remain was expressed by "none" (no cohesive failure).

TABLE 1

| | Hot-melt resins used in the invention | | | | Evaluation | | | |
|---|---|---|---|---|---|---|---|---|
| Example | Melting point | Molecular weight | Melting point | Molecular weight | Adhesive strength (g/25 mm) | 60° Specular gloss | Printing properties | Cohesive failure |
| Example 1 | 70° C. | 1000 | 107° C. | 5000 | 181 | 11.5 | ○ | Occurred |
| Example 2 | " | 1000 | 110 | 10000 | 215 | 20.5 | ○ | Occurred |
| Comparative Example 1 | " | 1000 | — | — | 31 | 65.7 | ○ | None |
| Example 3 | 89 | 2000 | 100 | 8000 | 204 | 8.3 | ○ | Occurred |
| Example 4 | " | 2000 | 105 | 20000 | 218 | 17.6 | ○ | Occurred |
| Comparative Example 2 | — | — | 105 | 20000 | 726 | 23.8 | X | Occurred |
| Example 5 | 83 | 2000 | 110 | 7000 | 148 | 5.5 | ○ | Occurred |
| Example 6 | " | 2000 | 132 | 10000 | 255 | 14.1 | ○ | Occurred |
| Comparative Example 3 | " | 2000 | — | — | 42 | 53.7 | ○ | None |
| Example 7 | 83 | 2000 | 155 | 10000 | 288 | 13.2 | ○ | Occurred |
| Example 8 | " | 2000 | 113 | 25000 | 312 | 25.9 | ○ | Occurred |
| Comparative Example 4 | — | — | 113 | 25000 | 809 | 18.6 | X | Occurred |

In Examples 1 to 8, the thermal transfer recording sheets produced by using two resins (two polyamide resins or two polyester resins) different in molecular weight had an adhesive strength (g/25 mm) in the range specified in the present invention. The glassiness was less than 30 for all of them. They gave a lusterless mat-type image. Cohesive failure occurred in all of them.

On the other hand, in Comparative Example 1, the adhesive strength was low, and the glossiness was 65.7, indicating that the printed image obtained was lustrous.

In this case, the printing properties were improved but no cohesive failure occurred.

In Comparative Example 2, since no polyamide resin having a low molecular weight was used, the adhesive strength was high, and although cohesive failure occurred, ink-missing and blurs were serious.

In Comparative Example 3, only a polyester resin having a low molecular weight was used, and hence the adhesive strength was low and no cohesive failure occurred. The printing properties were favorable but a lustrous printed image was given. Therefore, the thermal transfer recording sheet of Comparative Example 3 was not fit for the object of the present invention.

In Comparative Example 4, since only a polyester resin having a high molecular weight was used, the adhesive strength was extremely high, and cohesive failure was excessive, resulting in substantially no transfer to the image-receiving sheet. On the other hand, the glossiness was in the range specified in the present invention, but the printing properties were inferior. Therefore, the product obtained in Comparative Example 4 was not suitable as a thermal transfer recording sheet.

EXAMPLES 9 TO 12

Thermal transfer recording sheets were produced in the same manner as in Example 1, except for using hot-melt inks having the compositions shown below. They were evaluated in the same manner as in Example 1. The results obtained are shown in Table 2.

| Example 9 | |
|---|---|
| Polyamide resin (molecular weight 2,000, melting point 89° C.) | 10 parts |
| Polyamide resin (molecular weight 5,000, melting point 107° C.) | 60 parts |
| Lauric acid amide (melting point 80° C.) | 20 parts |
| Carbon black | 10 parts |

| Example 10 | |
|---|---|
| Polyamide resin (molecular weight 2,000, melting point 89° C.) | 80 parts |
| Polyamide resin (molecular weight 2,000, melting point 105° C.) | 10 parts |
| Carbon black | 10 parts |

| Example 11 | |
|---|---|
| Polyester (molecular weight 2,000, melting point 83° C.) | 10 parts |
| Polyester resin (molecular weight 7,000, melting point 110° C.) | 50 parts |
| Oxidized microcrystalline wax (melting point 77° C.) | 30 parts |
| Carbon black | 10 parts |

| Example 12 | |
|---|---|
| Polyester resin (molecular weight 2,000, melting point 83° C.) | 60 parts |
| Polyester resin (molecular weight 25,000, melting point 113° C.) | 10 parts |
| Oxidized microcrystalline wax (melting point 77° C.) | 20 parts |
| Carbon black | 10 parts |

TABLE 2

| Example | Adhesive strength (g/25 mm) | 60° Specular gloss | Printing properties | Cohesive failure |
|---|---|---|---|---|
| Example 9 | 240 | 16.6 | ○ | Occurred |
| Example 10 | 63 | 28.7 | ○ | Occurred |
| Example 11 | 273 | 9.4 | ○ | Occurred |
| Example 12 | 197 | 18.5 | ○ | Occurred |

In Examples 9 to 12, in preparing each hot-melt ink, the blending proportions o the hot-melt materials (polyamide resins or polyester resins) used in the present invention were in the ranges specified in the present invention. As can be seen from Table 2, the thermal transfer recording sheets obtained in Examples 9 to 12 were fit for the object of the present invention with respect to all of the evaluation items, i.e., adhesive strength (g/25 mm), 60° specular gloss, printing properties, and cohesive failure.

EXAMPLE 13

A saturated polyester resin having a molecular weight of 7,000, a melting point of 81° C., and a melting viscosity at 120° C. of 40 poise was used as a resin for island phase, and a polyethylene resin having a molecular weight of 5,000 and a melting point of 100° C. was used as a resin for sea phase. According to the recipe shown below, the ingredients were dispersed by means of a sand grinder at a temperature of 130° C. for 2 hours to obtain a hot-melt ink. The hot-melt ink obtained was coated on the uncoated surface of a polyester film of 5.2 μm in thickness having a heat-proofing layer coated on one side, to a thickness of 4 μm by means of a hot-melt coater to form a hot-melt ink layer, whereby a thermal transfer recording sheet was obtained.

| | |
|---|---|
| Carbon black | 15% |
| The saturated polyester resin | 40% |
| The polyethylene resin | 40% |
| Petroleum resin (melting point: 70° C.) | 5% |

The thermal transfer recording sheet thus obtained was placed on an image-receiving sheet for thermal transfer recording (TTR-T, a trade name, mfd. by Mitsubishi Paper Mills Ltd.), and printing of letters and solid printing were conducted at 1.3 mJ/dot by means of a thermal head printer mfd. by Matsushita Electronic Parts Co. to obtain clear mat-type printed images Said thermal transfer recording sheet was excellent also in the adherence of the substrate and the ink. The results of evaluation are shown in Table 3.

EXAMPLE 14

Using the same materials as in Example 13, a hot-melt ink was prepared according to the recipe shown below. A thermal transfer recording sheet was obtained by coating the hot-melt ink. By the use of this thermal transfer recording sheet, printing was conducted in the same manner as in Example 13. The results of evaluation are shown in Table 3.

| | |
|---|---|
| Carbon black | 15% |
| The saturated polyester resin | 20% |
| The polyethylene resin | 60% |
| Petroleum resin (melting point 70° C.) | 5% |

EXAMPLE 15

A saturated polyester resin having a molecular weight of 4,000, a melting point of 75° C. and a melting viscosity at 120° C. of 25 poise was used as a resin for island phase, and the same polyethylene resin as in Example 13 was used as a resin for sea phase. A hot-melt ink was prepared according to the same recipe as in Example 13, except for using the above polyester resin in place of that used in Example 13. A thermal transfer recording sheet was obtained by coating the hot-melt ink. Using this thermal transfer recording sheet, printing was conducted in the same manner as in Example 13.

The results of evaluation are shown in Table 3.

EXAMPLE 16

The same saturated polyester resin as in Example 13 was used as a resin for island phase, and an olefin resin derivative composed of copolymer of α-olefin and maleic anhydride which had a molecular weight of 3,000 and a melting point of 70° C. was used as a resin for sea phase. A hot-melt ink was prepared according to the recipe shown below. A thermal transfer recording sheet was obtained by coating the hot-melt ink. Using this thermal transfer recording sheet, printing was conducted in the same manner as in Example 13. The results of evaluation are shown in Table 3.

| | |
|---|---|
| Carbon black | 15% |
| The saturated polyester resin | 40% |
| The olefin resin derivative | 40% |
| Petroleum resin (melting point 70° C.) | 5% |

EXAMPLE 17

The same saturated polyester resin as in Example 13 was used as a resin for island phase, and an olefin resin derivative composed of copolymer of α-olefin and maleic anhydride which had a molecular weight of 9,000 and a melting point of 70° C. was used as a resin for sea phase. A hot-melt ink was prepared according to the same recipe as in Example 16, except for using the above olefin resin derivative in place of that used in Example 16. A thermal transfer recording sheet was obtained by coating the hot-melt ink. Using this thermal transfer recording sheet, printing was conducted in the same manner as in Example 13. The results of evaluation are shown in Table 3.

COMPARATIVE EXAMPLE 5

Using the same materials as in Example 13, a hot-melt ink was prepared according to the recipe shown below. A thermal transfer recording sheet was obtained by coating the hot-melt ink. By the use of this thermal transfer recording sheet, printing was conducted in the same manner as in Example 13.

The results of evaluation are shown in Table 3.

| | |
|---|---|
| Carbon black | 15% |
| The saturated polyester resin | 5% |
| The polyethylene resin | 75% |
| Petroleum resin (melting point 70° C.) | 5% |

COMPARATIVE EXAMPLE 6

Using the same materials as in Example 13, a hot-melt ink was prepared according to the recipe shown below. A thermal transfer recording sheet was obtained by coating the hot-melt ink. By the use of this thermal transfer recording sheet, printing was conducted in the same manner as in Example 13.

The results of evaluation are shown in Table 3.

| | |
|---|---|
| Carbon black | 15% |
| The saturated polyester resin | 60% |
| The polyethylene resin | 20% |
| Petroleum resin (melting point 70° C.) | 5% |

COMPARATIVE EXAMPLE 7

A saturated polyester resin having a molecular weight of 10,000, a melting point of 90° C. and a melting viscosity at 120° C. of 60 poise was used as a resin for island phase, and the same polyethylene resin as in Example 13 was used as a resin for sea phase. A hot-melt ink was prepared according to the same recipe as in Example 13, except for using the above saturated polyester resin in place of that used in Example 13. A thermal transfer recording sheet was obtained by coating the hot-melt ink. Using this thermal transfer recording sheet, printing was conducted in the same manner as in Example 13.

The results of evaluation are shown in Table 3.

EXAMPLE 18

A polyamide resin having a molecular weight of 2,000, a melting point of 89° C. and a melting viscosity at 120° C. of 45 poise was used as a resin for island phase, and the same polyethylene resin as in Example 13 was used as a resin for sea phase. A hot-melt ink was prepared according to the recipe shown below. A thermal transfer recording sheet was obtained by coating the hot-melt ink. Using this thermal transfer recording sheet, printing was conducted in the same manner as in Example 13.

The results of evaluation are shown in Table 4.

| | |
|---|---|
| Carbon black | 15% |
| The polyamide resin | 40% |
| The polyethylene resin | 40% |
| Petroleum resin (melting point 70° C.) | 5% |

EXAMPLE 19

Using the same materials as in Example 18, a hot-melt ink was prepared according to the recipe shown below. A thermal transfer recording sheet was obtained by coating the hot-melt ink. By the use of this thermal transfer recording sheet, printing was conducted in the same manner as in Example 13.

The results of evaluation are shown in Table 4.

| | |
|---|---|
| Carbon black | 15% |
| The polyamide resin | 20% |
| The polyethylene resin | 60% |
| Petroleum resin (melting point 70° C.) | 5% |

EXAMPLE 20

A polyamide resin having a molecular weight of 1,000, a melting point of 89° C. and a melting viscosity at 120° C. of 30 poise was used as a resin for island phase, and the same polyethylene resin as in Example 13 was used as a resin for sea phase. A hot-melt ink was prepared according to the same recipe as in Example 18, except for using the above polyamide resin in place of that used in Example 18. A thermal transfer recording sheet was obtained by coating the hot-melt ink. Using this thermal transfer recording sheet, printing was conducted in the same manner as in Example 13.

The results of evaluation are shown in Table 4.

EXAMPLE 21

The same polyamide resin as in Example 18 was used as a resin for island phase, and the same olefin resin derivative as in Example 16 was used as a resin for sea phase. A hot-melt ink was prepared according to the recipe shown below. A thermal transfer recording sheet was obtained by coating the hot-melt ink. Using this thermal transfer recording sheet, printing was conducted in the same manner as in Example 13. The results of evaluation are shown in Table 4.

| | |
|---|---|
| Carbon black | 15% |
| The polyamide resin | 40% |
| The olefin resin derivative | 40% |
| Petroleum resin (melting point 70° C.) | 5% |

EXAMPLE 22

The same polyamide resin as in Example 18 was used as a resin for island phase and the same olefin resin derivative as in Example 17 was used as a resin for sea phase. A hot-melt ink was prepared according to the same recipe as in Example 21, except for using the above olefin resin derivative in place of that used in Example 21. A thermal transfer recording sheet was obtained by coating the hot-melt ink. Using this thermal transfer recording sheet, printing was conducted in the same manner as in Example 13. The results of evaluation are shown in Table 4.

COMPARATIVE EXAMPLE 8

Using the same materials as in Example 18, a hot-melt ink was prepared according to the recipe shown below. A thermal transfer recording sheet was obtained by coating the hot-melt ink. By the use of this thermal transfer recording sheet, printing was conducted in the same manner as in Example 13.

The results of evaluation are shown in Table 4.

| | |
|---|---|
| Carbon black | 15% |
| The polyamide resin | 5% |
| The polyethylene resin | 75% |
| Petroleum resin (melting point 70° C.) | 5% |

COMPARATIVE EXAMPLE 9

Using the same materials as in Example 18, a hot-melt ink was prepared according to the recipe shown below. A thermal transfer recording sheet was obtained by coating the hot-melt ink. By the use of this thermal transfer recording sheet, printing was conducted in the same manner as in Example 13.

The results of evaluation are shown in Table 4.

| | |
|---|---|
| Carbon black | 15% |
| The polyamide resin | 60% |
| The polyethylene resin | 20% |
| Petroleum resin (melting point 70° C.) | 5% |

COMPARATIVE EXAMPLE 10

A polyamide resin having a molecular weight of 5,000, a melting point of 107° C. and a melting viscosity at 120° C. of 65 poise was used as a resin for island phase, and the same polyethylene resin as in Example 13 was used as a resin for sea phase. A hot-melt ink was prepared according to the same recipe as in Example 18, except for using the above polyamide resin in place of that used in Example 18. A thermal transfer recording sheet was obtained by coating the hot-melt ink. Using this thermal transfer recording sheet, printing was conducted in the same manner as in Example 13.

The results of evaluation are shown in Table 4.

The evaluation methods employed in Examples 13 to 22 and Comparative Examples 5 to 10 were the same as in Examples 1 to 12.

TABLE 3

| | Resin for island phase | Viscosity (Poise at 120° C.) | Blending amount (%) | Resin for sea phase | Blending amount (%) | Glossiness | Ink adhesion | Printing properties |
|---|---|---|---|---|---|---|---|---|
| Example 13 | Polyester | 40 | 20 | Polyethylene | 40 | 3 | ○ | ○ |
| Example 14 | " | 40 | 20 | " | 60 | 8 | ○ | ○ |
| Example 15 | " | 25 | 40 | " | 40 | 19 | ○ | ○ |
| Example 16 | " | 40 | 40 | Olefin resin derivative | 40 | 10 | ○ | ○ |
| Example 17 | " | 40 | 40 | Olefin resin derivative | 40 | 9 | ○ | ○ |
| Comparative Example 5 | " | 40 | 5 | Polyethylene | 75 | 55 | X~Δ | ○ |
| Comparative Example 6 | " | 40 | 60 | " | 20 | 6 | | X |
| Comparative Example 7 | " | 60 | 40 | " | 40 | — | — | — |

A thermal transfer recording sheet was obtained by

TABLE 4

| | Resin for island phase | Viscosity (Poise at 120° C.) | Blending amount (%) | Resin for sea phase | Blending amount (%) | Glossiness | Ink adhesion | Printing properties |
|---|---|---|---|---|---|---|---|---|
| Example 18 | Polyamide | 45 | 40 | Polyethylene | 40 | 4 | ○ | ○ |
| Example 19 | " | 45 | 20 | " | 60 | 7 | ○ | ○ |
| Example 20 | " | 30 | 40 | " | 40 | 12 | ○ | ○ |
| Example 21 | " | 45 | 40 | Olefin resin | 40 | 5 | ○ | ○ |

TABLE 4-continued

| | Resin for island phase | Viscosity (Poise at 120° C.) | Blending amount (%) | Resin for sea phase | Blending amount (%) | Glossiness | Ink adhesion | Printing properties |
|---|---|---|---|---|---|---|---|---|
| | | | | derivative | | | | |
| Example 22 | " | 45 | 40 | Olefin resin derivative | 40 | 8 | ○ | ○ |
| Comparative Example 8 | " | 45 | 5 | Polyethylene | 75 | 50 | X | ○ |
| Comparative Example 9 | " | 45 | 60 | " | 20 | — | — | — |
| Comparative Example 10 | " | 65 | 40 | " | 40 | — | — | — |

Ink adhesion
○; Excellent in adhesion to substrate
Δ; Inferior to some degree in adhesion to substrate
X; Easily peelable from substrate
Printing properties
○; Clear printed letters without ink-missing and blurs
Δ; A few ink-missing and blurs
X; Many ink-missing and blurs (unsatisfactory transfer)

The thermal transfer recording sheet of Example 13 was excellent in ink adhesion to substrate and gave a clear mat-type image.

The thermal transfer recording sheet of Example 14 was obtained in the same manner as in Example 13, except that the blending amount of the saturated polyester resin was changed to 20%. It was excellent in ink adhesion to substrate and gave a clear mat-type printed image. The thermal transfer recording sheet of Example 15 was obtained in the same manner as in Example 13, except that a saturated polyester resin having a lower molecular weight was used in place of the saturated polyester resin used in Example 13. It was excellent in ink adhesion to substrate and gave a clear mat-type printed image.

The thermal transfer recording sheets of Examples 16 and 17 were obtained in the same manner as in Example 13, except that two olefin resin derivatives different in molecular weight were used, respectively, in place of the polyethylene resin used in Example 13. They were excellent in ink adhesion to substrate and gave a clear mat-type printed image.

The thermal transfer recording sheet of Comparative Example 5 was obtained in the same manner as in Example 13, except that the blending amount of the saturated polyester resin was changed to 5%. In this thermal transfer recording sheet, the formation of an island-sea structure, i.e., a nonuniformly mixed state, was insufficient in the hot-melt ink, namely, the formation of an interface between the resin for island phase and the resin for sea phase was insufficient in the hot-melt ink layer. This thermal transfer recording sheet was poor in ink adhesion to substrate and gave a lustrous printed image.

The thermal transfer recording sheet of Comparative Example 6 was obtained in the same manner as in Example 13, except that the blending amount of the saturated polyester resin was changed to 60%. It was inferior in printing properties as follows. Since the melting viscosity of ink was increased and the ink adhesion to substrate was too strong, there were many ink-missing and blurs on the printed surface.

The thermal transfer recording sheet of Comparative Example 7 was obtained in the same manner as in Example 13, except that a saturated polyester resin having a high molecular weight was used in place of the saturated polyester resin used in Example 13. No ink could be prepared because of the high melting viscosity of that saturated polyester resin.

The thermal transfer recording sheet of Example 18 was excellent in ink adhesion to substrate and gave a clear mat-type printed image. The thermal transfer recording sheet of Example 19 was obtained in the same manner as in Example 18, except that the blending amount of the polyamide resin was changed to 20%. It was excellent in ink adhesion to substrate and gave a clear mat-type printed image.

The thermal transfer recording sheet of Example 20 was obtained in the same manner as in Example 18, except that a polyamide resin having a lower molecular weight was used in place of the polyamide resin used in Example 18. It was excellent in ink adhesion to substrate and gave a clear mat-type printed image. The thermal transfer recording sheets of Examples 21 and 22 were obtained in the same manner as in Example 18, except that two olefin resin derivatives different in molecular weight were used, respectively, in place of the polyethylene resin used in Example 18. They were excellent in ink adhesion to substrate and gave a clear mat-type printed image.

The thermal transfer recording sheet of Comparative Example 8 was obtained in the same manner as in Example 18, except that the blending amount of the polyamide resin was changed to 5%. In this thermal transfer recording sheet, the formation of an island-sea structure, i.e., a nonuniformly mixed state, was insufficient in the hot-melt ink. This thermal transfer recording sheet was poor in ink adhesion to substrate and gave a lustrous printed image.

The thermal transfer recording sheet of Comparative Example 9 was obtained in the same manner as in Example 18, except that the blending amount of the polyamide resin was changed to 60%. In this case, because of an increase in the melting viscosity of ink, neither sufficient dispersion and mixing nor coating on a substrate was possible.

The thermal transfer recording sheet of Comparative Example 10 was obtained in the same manner as in Example 18, except that a polyamide resin having a high molecular weight was used in place of the polyamide resin used in Example 18. No ink could be prepared because of the high melting viscosity of that polyamide resin.

As described above, as compared with conventional thermal transfer recording sheets, the thermal transfer recording sheet of the present invention gives a printed image with a low gloss and is excellent in mat-type printing properties. Therefore, it is industrially very useful.

What is claimed is:

1. A thermal transfer recording sheet, used on an image receiving sheet to form a mat surface printed image, comprising:

a substrate and a hot-melt ink layer, coated on one side of the substrate, said hot-melt ink layer comprising two resins, one having a low molecular weight of less than 3,000–4,000 and the other resin having a relatively high molecular weight of not more than 25,000–30,000 and not less than 3,000–4,000, having an adhesive strength (g/25 mm) to the substrate in the range of 50 to 500 g/25 mm when hot (80° C.) as measured in accordance with the 180° peel adhesive strength test method specified in JIS K6854, wherein the hot-melt ink layer undergoes cohesive failure when the thermal transfer sheet is peeled off to leave a mat surface printed image on an image-receiving sheet after thermal transfer, said mat surface printed image having a 60° specular gloss of 30 or less as measured by the specular gloss measuring method specified in JIS Z8741.

2. A thermal transfer recording sheet according to claim 1, wherein the two resins comprising the hot-melt ink layer comprise two polyamide resins having molecular weights of less than 4,000 and 4,000–30,000, respectively.

3. A thermal transfer recording sheet according to claim 2, wherein in compounding said hot-melt ink layer, the polyamide resin having a molecular weight of less than 4,000 is used in an amount of 10 to 80 parts by weight, and the polyamide resin having a molecular weight of 4,000–30,000 is used in an amount of 10 to 60 parts by weight.

4. A thermal transfer recording sheet according to claim 1, wherein the two resins comprising the hot-melt ink layer comprise two saturated polyester resins having molecular weights of less than 3,000 and 3,000–25,000, respectively.

5. A thermal transfer recording sheet according to claim 4, wherein in compounding said hot-melt ink layer, the saturated polyester resin having the molecular weight of less than 3,000 was used in an amount of 10 to 60 parts by weight, and the saturated polyester resin having a molecular weight of 3,000–25,000 is used in an amount of 10 to 50 parts by weight.

6. A thermal transfer recording sheet according to claim 1, wherein said substrate comprises a polyester film.

7. A thermal transfer recording sheet comprising a substrate and a hot-melt ink layer coated on one side of the substrate, said hot-melt ink layer comprising two or more resins which are incompatible or partially compatible with each other, wherein said resins undergo micro-phase separation to fall into a non-uniformly mixed state and constitute an island phase and a sea phase, respectively, resulting in formation of an island-sea structure, and the island phase is selectively left at the time of thermal transfer printing, wherein an image having a 60° specular gloss of 30 or less as measured by the specular gloss measuring method specified in JIS Z 8741 can be printed on an image receiving sheet.

8. A thermal transfer recording sheet according to claim 9, wherein the resin which forms the island phase is a saturated polyester resin having a melting viscosity at 120° C. of 50 poise or less, and the resin which forms the sea phase is at least one olefin resin selected from the group consisting of polyethylenes, polypropylenes and polybutenes.

9. A thermal transfer recording sheet according to claim 8, wherein in compounding said hot-melt ink layer, said saturated polyester resin is included therein in an amount of 10 to 40% by weight and said olefin resin 40 to 70% by weight.

10. A thermal transfer recording sheet according to claim 9, wherein the resin which forms the island phase is a dimer acid-based polyamide resin having a melting viscosity at 120° C. of 50 poise or less, and the resin which forms the sea phase is at least one olefin resin selected from the group consisting of polyethylenes, polypropylenes and polybutenes.

11. A thermal transfer recording sheet according to claim 10, wherein in compounding said hot-melt ink layer, said polyamide resin is included therein in an amount of 10 to 40% by weight and said olefin resin 40 to 70% by weight.

12. A thermal transfer recording sheet according to claim 7, wherein said substrate is a polyester film.

* * * * *